US007646365B2

(12) United States Patent
Kim et al.

(10) Patent No.: US 7,646,365 B2
(45) Date of Patent: Jan. 12, 2010

(54) METHOD AND APPARATUS FOR DRIVING ELECTRO-LUMINESCENCE DISPLAY DEVICE WITH MULTIPLE SCAN DRIVE CURRENTS

(75) Inventors: Hyun Joung Kim, Daegu-kwangyeokshi (KR); Hak Su Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 469 days.

(21) Appl. No.: 10/950,593

(22) Filed: Sep. 28, 2004

(65) Prior Publication Data

US 2005/0093786 A1 May 5, 2005

(30) Foreign Application Priority Data

Sep. 30, 2003 (KR) ..... 10-2003-0067837

(51) Int. Cl.
*G09G 3/30* (2006.01)

(52) U.S. Cl. ..... 345/82; 345/76

(58) Field of Classification Search ..... 345/74.1, 345/76, 94, 204, 208, 692, 77, 98–102, 82, 345/38, 48, 50, 51, 55, 87; 315/169.3
See application file for complete search history.

(56) References Cited

U.S. PATENT DOCUMENTS 4,948,966 A * 8/1990 Arques et al. ..... 250/208.1
5,838,289 A * 11/1998 Saito et al. ..... 345/79
5,856,813 A * 1/1999 Katayama et al. ..... 345/76
5,874,933 A * 2/1999 Hirai et al. ..... 345/89
5,973,456 A * 10/1999 Osada et al. ..... 315/169.1
6,204,610 B1 * 3/2001 Komiya ..... 315/169.3
6,489,952 B1 * 12/2002 Tanaka et al. ..... 345/205
6,608,448 B2 * 8/2003 Boer ..... 315/169.3
6,621,228 B2 * 9/2003 Harada et al. ..... 315/169.3
6,633,136 B2 * 10/2003 Kim et al. ..... 315/169.3
2004/0041761 A1 * 3/2004 Sugita et al. ..... 345/87

* cited by examiner

*Primary Examiner*—Chanh Nguyen
*Assistant Examiner*—Pegeman Karimi
(74) *Attorney, Agent, or Firm*—Birch, Stewart, Kolasch & Birch, LLP

(57) ABSTRACT

A method and apparatus for driving an electro-luminescence display device capable of preventing a defect of signal lines caused by a relatively high scan voltage and current is disclosed. In the apparatus, a display panel has a scan line, a data line intersecting the scan line and supplied with a data, and a light-emitting device positioned at the intersection between the scan line and the data line. A data driver supplies a data to the data line. A scan driver applies a scanning pulse having a different current component to the scan line during a desired period.

7 Claims, 11 Drawing Sheets

METHOD AND APPARATUS FOR DRIVING ELECTRO-LUMINESCENCE DISPLAY DEVICE WITH MULTIPLE SCAN DRIVE CURRENTS

This application claims the benefit of Korean Patent Application No. P2003-67837 filed in Korea on Sep. 30, 2003, which is hereby incorporated by reference.

BACKGROUND OF THE INVENTION

1. Field of the Invention

This invention relates to an electro-luminescence display (ELD), and more particularly to a method and apparatus for driving an electro-luminescence display device that is capable of preventing a defect of signal lines caused by a relatively high scan voltage and current.

2. Description of the Related Art

Recently, there have been highlighted various flat panel display devices reduced in weight and bulk that is capable of eliminating disadvantages of a cathode ray tube (CRT). Such flat panel display devices include a liquid crystal display (LCD), a field emission display (FED), a plasma display panel (PDP) and an electro-luminescence (EL) display, etc.

The EL display device is largely classified into an inorganic EL device and an organic EL device, and has advantages of a fast response speed, high light-emission efficiency, a high brightness and a wide viewing angle. Since the organic EL display device can display a picture at a high brightness of tens thousands of [cd/m$^2$] by a voltage of approximately 10 [V], it has been highlighted as a post-generation display device.

In the organic EL cell, as shown in FIG. 1, an anode 12 is formed from a transparent conductive material on a substrate 11; and a hole injection layer 13, a light-emitting layer 14 made from an organic material and a cathode 15 made from a metal having a low work function are disposed thereon. If an electric field is applied between the anode 12 and the cathode 15, holes within the hole injection layer 13 and electrons within the metal are progressed into the light-emitting layer 14. Then, a phosphorous material within the light-emitting layer 14 is excited and transited to thereby generate a visible light. In this case, the brightness is in proportion to a current between the anode 12 and the cathode 15.

FIG. 2 shows a general passive matrix type EL display device.

Referring to FIG. 2, the EL display device includes a EL display panel 20 having EL cells 18 arranged at intersections between 1st to nth scan lines SL1 to SLn and 1st to mth data lines DL1 to DLm, a scan driver 22 for driving the scan lines SL, and a data driver 24 for driving the data lines DL.

Each of EL cells 18 is selected when a scanning pulse is applied to the scan line SL connected to the cathode to thereby generate a light corresponding to a pixel signal applied to the data line DL connected to the anode, that is, a current signal. Each EL cell 18 can be equivalently expressed as a diode connected between the data line DL and the scan line SL. In each EL cell 18, as shown in FIG. 3, a negative scanning pulse SCAN is applied to the scan line SL and, at the same time, a positive current according to a data signal DATA is applied to the data line DL, thereby radiating it when a forward voltage is loaded. Otherwise, a backward voltage is applied to the EL cells 18 included in the unselected scan lines 18, so that it is not radiated. In other words, forward electric charges are charged into the radiating EL cells 18, whereas backward electric charges are charged into the non-radiating EL cells 18.

The data driver 24 applies a current signal DATA having a current level or a pulse width responding to a data signal for each horizontal period to the 1st to mth data lines DL1 to DLm.

The scan driver 22 applies a negative scanning pulse SCAN to the 1st to nth scan lines SL1 to SLn on a line sequence basis. The scan driver 22 includes first and second switches T1 and T2 connected in a push-pull type as shown in FIG. 4.

The first switch device T1 connected to a scan high voltage source Vhigh supplies a scan high voltage Vhigh to the scan lines SL1 to SLn in response to a control signal A1. While an inverse voltage being applied to the organic EL cells 18 in which the scan high voltage Vhigh is supplied to the cathode 15, a backward current directing from the cathode 15 into the anode 12 is flown into the EL cells 18 to thereby cause a non-radiation of the EL cells 18.

The second switching device T2 connected to a ground voltage source GND sequentially supplies a scan voltage with a ground voltage GND to the scan lines SL1 to SLn in response to a second control signal A2, thereby selecting the scan lines SL1 to SLn at which a data is displayed. A forward current ion directing from the anode 12 into the cathode 15 flows into the organic EL cell 18 in which the ground voltage GND is applied to the cathode 15 and, at the same time, a positive current is applied to the anode 12, thereby radiating the organic EL cell 18.

Such an EL display device applies a scanning pulse lowered by a threshold voltage in response to a data pulse to the scan lines SL. If a magnitude of the scanning pulse is lower than that of the data pulse by the threshold voltage of the EL cell 18, the panel generates a cross talk phenomenon. Thus, a voltage of the scanning pulse fails to have a low value. Further, since the scanning pulse is sequentially applied to the 1st to nth scan lines SL1 to SLn, a waveform shape of the scanning pulse must be constantly kept. In other words, in order to prevent a cross talk while constantly keeping a shape of the scanning pulse, a current magnitude of the scanning pulse must keep a magnitude similar to capacitances of the first and second switches T1 and T2 positioned at the scan driver 22.

In this case, since a time when a reverse bias is applied by the scan high voltage is longer than a time when a data voltage is applied, a line defect is caused by the scan high voltage and the current for a relatively long time. This is because the scan high voltage is relatively higher and hence a magnitude of the scan current is larger in proportion to it. In other words, when the panel has badness, a partially high stress is applied to heighten a probability of the line defect.

In a driving apparatus of the conventional EL display device, since the data driver 24 allows a current to be applied to the organic EL cell 18 in a data enable (DE) interval having a high state as shown in FIG. 5, the scan driver 22 does not need a relatively large current. On the other hand, since the data driver 24 supplies a low voltage or a ground voltage to the data lines DL in a data enable (DE) interval having a low state and the scan driver 22 must select the next scan line at the current scan line, the scan driver 22 needs a relatively large current. For instance, when it is intended to select the 2nd scan line SL2 at the 1st scan line SL1, a first scanning pulse applied to the 1st scan line SL1 is changed from a low state into a high state while a second scanning pulse applied to the 2nd scan line SL2 is changed from a high state into a low state. When the first scanning pulse is changed from a low state into a high state, the data enable signal DE also is changed from a high state into a low state. Thus, since a current from the data driver 24 has been applied to the organic EL cell 18, a relatively large amount of electrons are accumulated onto the cathode of the organic EL cell 18. Because these accumulated electrons must be eliminated, a relatively large current is required when the scanning pulse is changed from a low state into a high state. However, there is raised a problem in that a scan voltage and a current applied to the scan lines SL are always constantly supplied in the prior art.

SUMMARY OF THE INVENTION

Accordingly, it is an object of the present invention to provide a method and apparatus for driving an electro-luminescence display device that is capable of preventing a defect of signal lines caused by a relatively high scan voltage and current.

In order to achieve these and other objects of the invention, a driving apparatus for an electro-luminescence display device according to one aspect of the present invention includes a display panel having a scan line, a data line intersecting the scan line and supplied with a data, and a light-emitting device positioned at the intersection between the scan line and the data line; a data driver for supplying a data to the data line; and a scan driver for applying a scanning pulse having a different current component to the scan line during a desired period.

In the driving apparatus, the scan driver is synchronized with a data enable signal indicating a time interval when said data exists to apply said scanning pulse having said different current component to the scan line.

A current component of said scanning pulse applied to the scan line during a rising interval when said scanning pulse is changed from a low state into a high state is larger than that during the remaining interval other than said rising interval.

The scan driver includes a first switch for selectively supplying a ground voltage of said scanning pulse to the scan line; and a second switch for supplying a scan high voltage in which a current in a sustain period for keeping a high state of said scanning pulse excluding said rising interval is larger than a current in said rising interval.

Herein, the second switch has a first channel width during said rising interval while having a second channel width smaller than said first channel width during said sustain period.

Herein, a control signal applied to a gate terminal of the second switch during said rising interval has a higher voltage level than a control signal applied to the gate terminal of the second switch during said sustain period.

Alternatively, the scan driver includes a first switch for selectively supplying a ground voltage to the scan line; a second switch for selectively supplying a scan high voltage to the scan line; and a signal controller for controlling a level of said scan high voltage.

Herein, the signal controller includes a third switch turned on in a rising interval when said scanning pulse is changed from a low state into a high state to thereby supply a first scan high voltage to the second switch; and a resistor connected, in parallel, to the third switch to supply a second scan high voltage having a lower voltage level than the first scan high voltage to the second switch during a sustain period for keeping said scanning pulse with said high state.

Alternatively, the scan driver includes a first switch for selectively supplying a ground voltage to the scan line; a second switch connected between the first switch and a scan high voltage source; a third switch for forming a current mirror along with the second switch; and a signal controller for controlling a control signal applied to a gate terminal of the second switch.

Herein, the signal controller includes a fourth switch turned on in a rising interval when said scanning pulse is changed from a low state into a high state to thereby supply a first control signal to the second switch; and a resistor connected, in parallel, to the fourth switch to supply a second control signal having a lower voltage level than the first control signal to the second switch during the remaining interval other than said rising interval.

A method of driving an electro-luminescence display device according to another aspect of the present invention includes the steps of (A) applying a scanning pulse having a different current component to a scan line during a desired interval; and (B) supplying a data to a data line crossing the scan line in synchronization with said scanning pulse.

In the method, said (A) step includes generating said scanning pulse having said different current component during said desired interval; and generating said scanning pulse having said different current component in synchronization with a data enable signal indicating a time interval when said data exists.

Said (A) step includes supplying a scan high voltage in which a current in a sustain period for keeping a high state of said scanning pulse excluding a rising interval is larger than a current in said rising when said scanning pulse is changed from a low state into a high state; and selectively supplying a ground voltage to the scan line in a time interval when a low state of said scanning pulse is kept.

Said (A) step includes supplying a scanning pulse with a first scan high voltage to the scan line in a rising interval when said scanning pulse is changed from a low state into a high state; and supplying a scanning pulse with a second scan high voltage having a lower voltage level than said first scan high voltage to the scan line in a sustain period for keeping a high state of said scanning pulse other than said rising interval.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Reference will now be made in detail to the preferred embodiments of the present invention, examples of which are illustrated in the accompanying drawings.

Hereinafter, the preferred embodiments of the present invention will be described in detail with reference to FIGS. 6 to 11.

Figure 6:
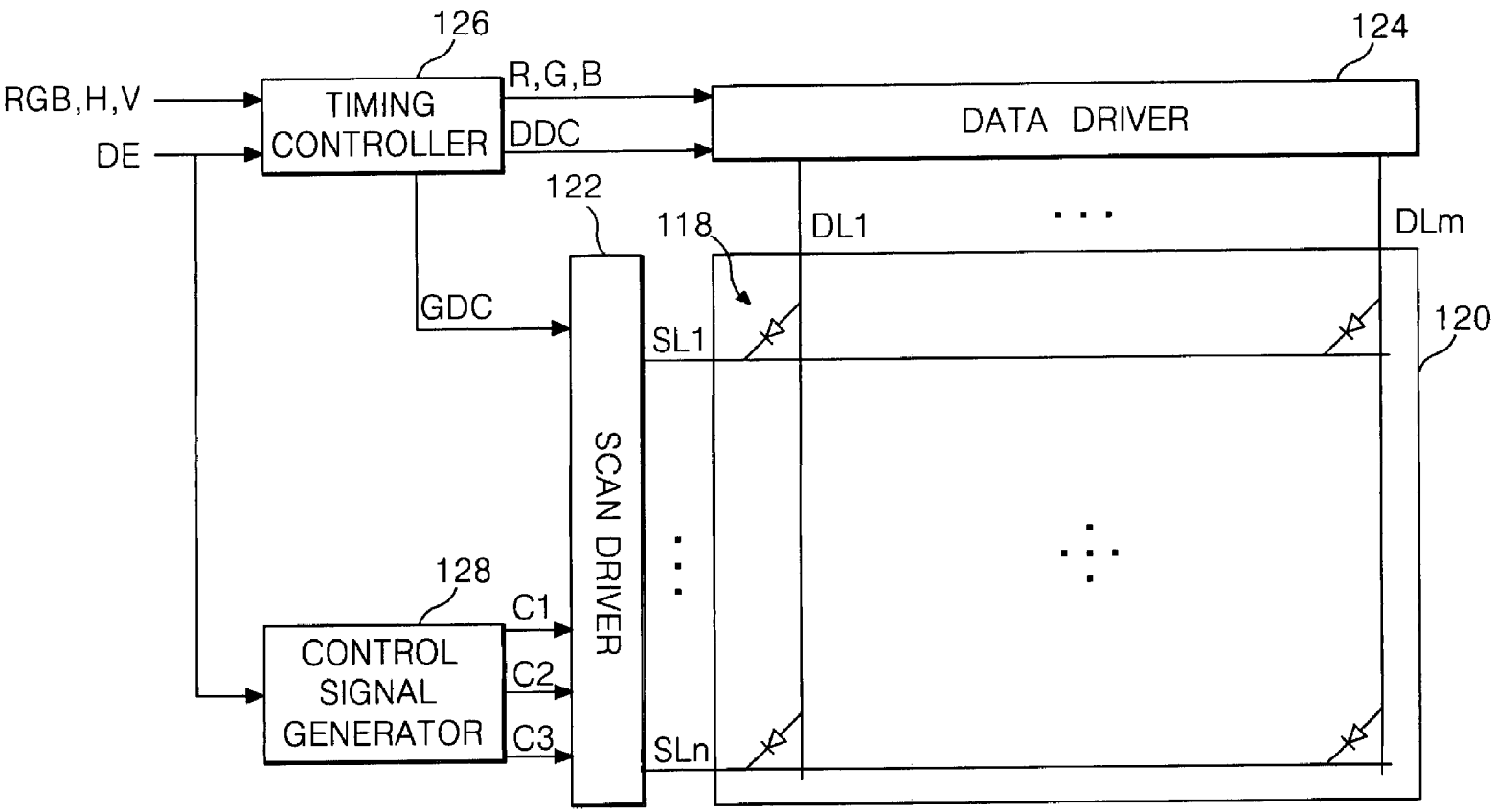
FIG. 6 is a schematic block diagram showing a configuration of a driving apparatus for an organic electro-luminescence display device according to a first embodiment of the present invention.

FIG. 6 shows a configuration of a driving apparatus for an organic electro-luminescence (EL) display device according to a first embodiment of the present invention.

Referring to FIG. 6, the EL display device according to the first embodiment of the present invention includes a EL display panel 120 having EL cells 118 arranged at intersections between 1st to nth scan lines SL1 to SLn and 1st to mth data lines DL1 to DLm, a scan driver 122 for driving the scan lines SL, a data driver 124 for driving the data lines DL, a timing controller for controlling the scan driver 122 and the data driver 124, and a control signal generator 128 for controlling first and second switching devices T1 and T2 included in the scan driver 122.

Figure 1:
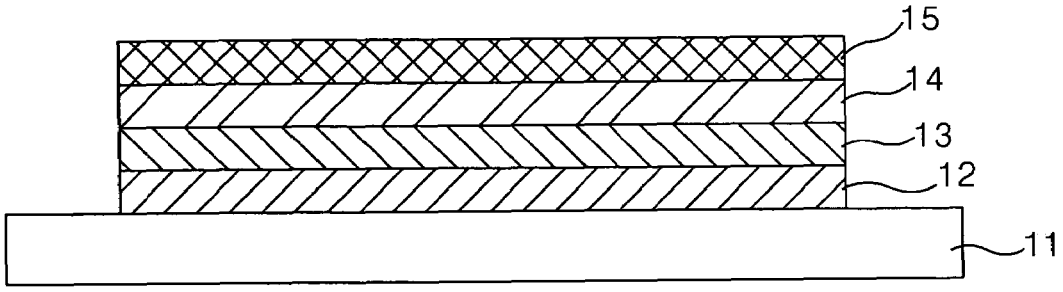
FIG. 1 RELATED ART
FIG. 1 is a schematic section view showing a structure of a conventional organic electro-luminescence cell.
Figure 2:
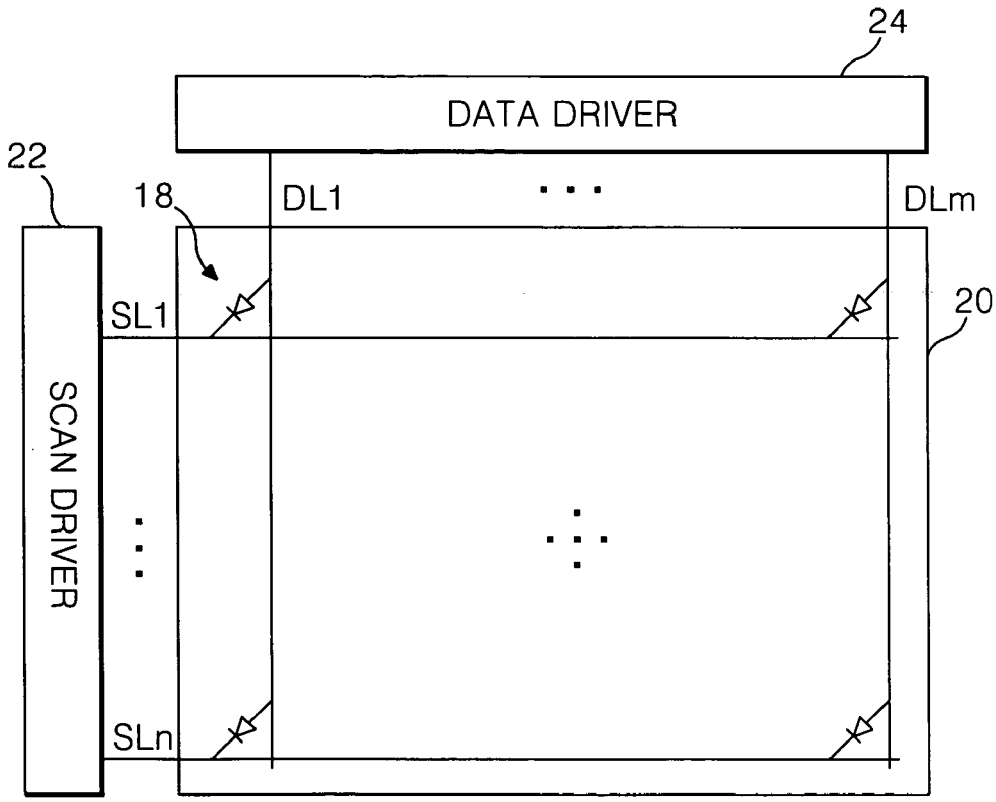
FIG. 2 RELATED ART
FIG. 2 is a schematic block diagram showing a configuration of a conventional organic electro-luminescence display device and a driving apparatus thereof.
Figure 3:
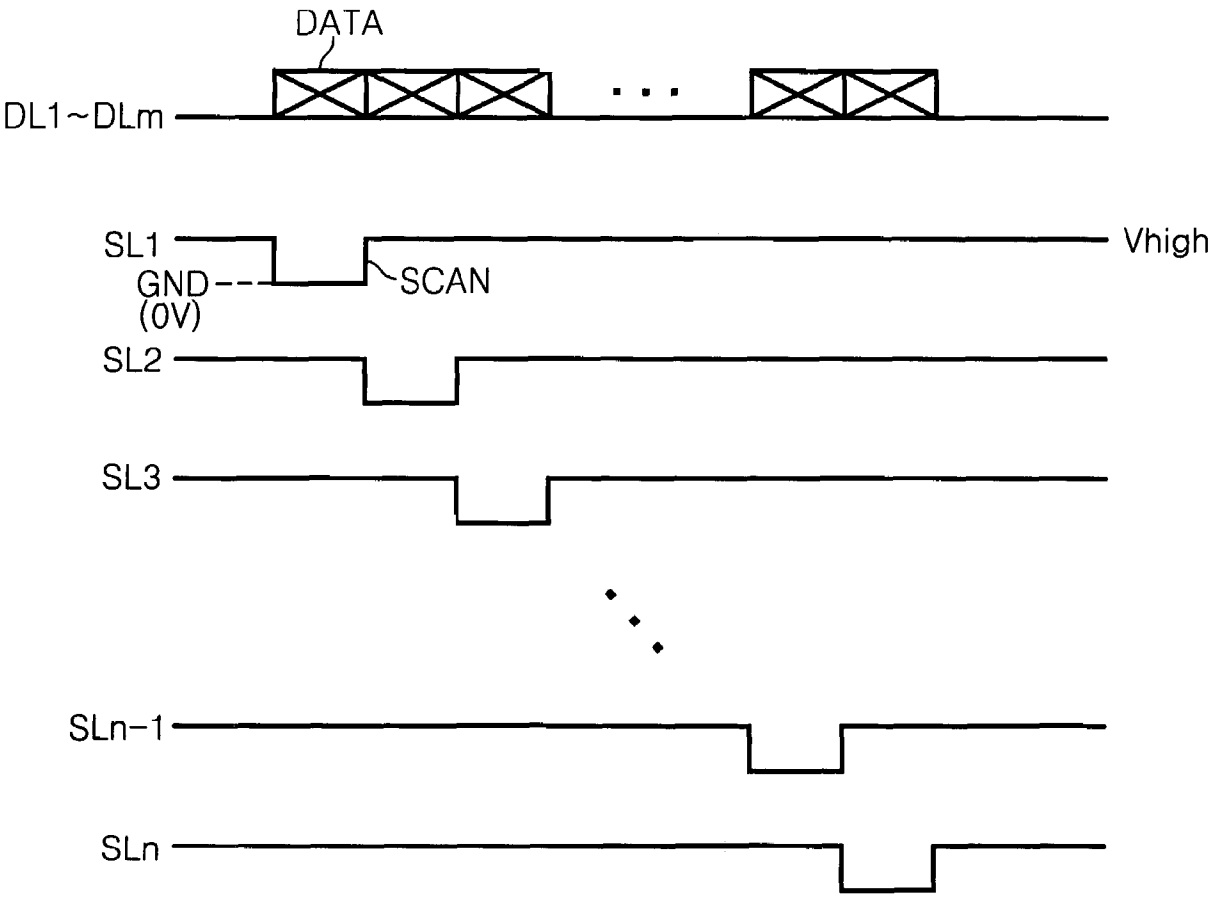
FIG. 3 RELATED ART
FIG. 3 is a waveform diagram of driving signals generated from the driving apparatus for the organic electro-luminescence display device shown in FIG. 2.
Figure 4:
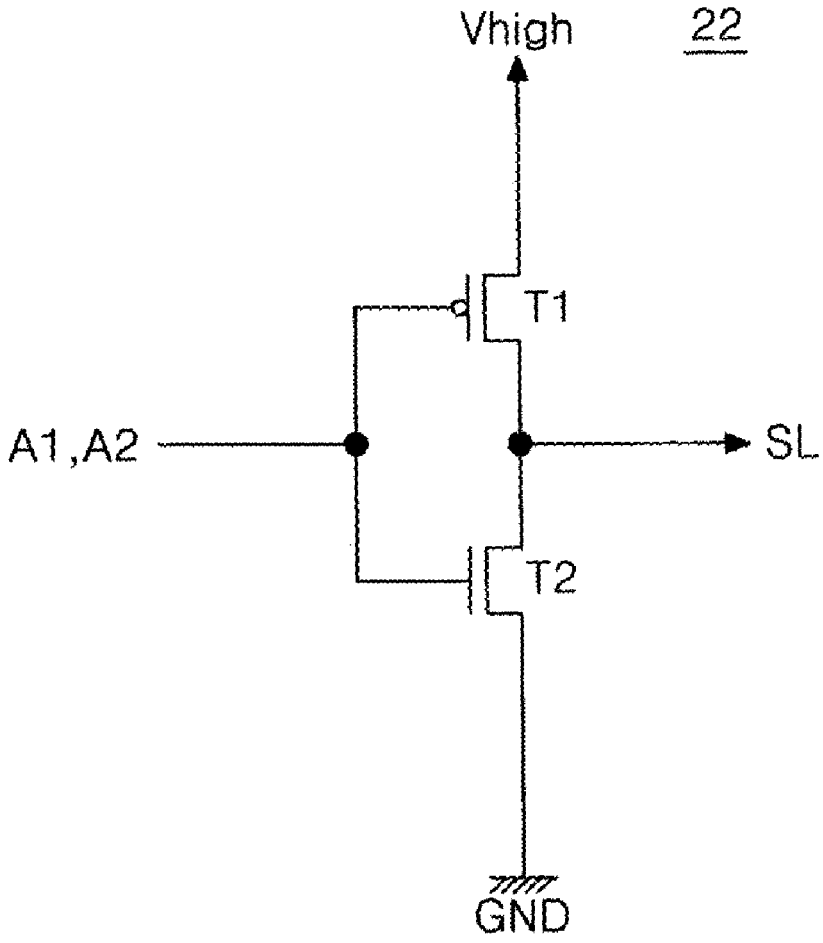
FIG. 4 RELATED ART
FIG. 4 is a circuit diagram of the first and second switches included in the scan driver shown in FIG. 2.
Figure 5:
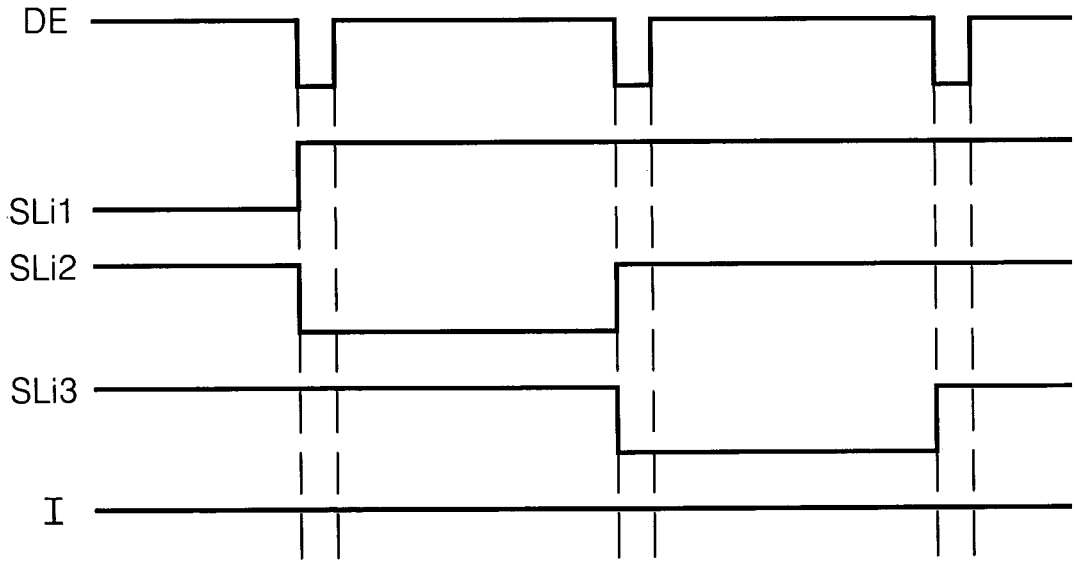
FIG.5 RELATED ART
FIG. 5 is a waveform diagram of the current included in the scan voltage shown in FIG. 3.

Each of EL cells 118 is selected when a scanning pulse is applied to the scan line SL connected to the cathode to thereby generate a light corresponding to a pixel signal applied to the data line DL connected to the anode, that is, a current signal. Each EL cell 118 can be equivalently expressed as a diode connected between the data line DL and the scan line SL. In each EL cell 118, as shown in FIG. 3, a negative scanning pulse SCAN is applied to the scan line SL and, at the same time, a positive current according to a data signal DATA is applied to the data line DL, thereby radiating it when a forward voltage is loaded. Otherwise, a backward voltage is applied to the EL-cells 118 included in the unselected scan lines 18, so that it is not radiated. In other words, forward electric charges are charged into the radiating EL cells 118, whereas backward electric charges are charged into the non-radiating EL cells 118.

The timing controller 126 generates a data control signal DDC for controlling the data driver 124 and a scan control signal GDC for controlling the scan driver 122 using synchronizing signals from an external system (e.g., graphic card). The data control signal DDC from the timing controller 126 is applied to the data driver 124 to thereby control the data driver 124. The scan control signal GDC from the timing controller 126 is applied to the scan driver 122 to thereby control the scan driver 122. Further, the timing controller 126 applies digital data signals from the external system to the data driver 124.

The data driver 124 applies a current signal DATA having a current level or a pulse width responding to a data signal for each horizontal period to the 1st to mth data lines DL1 to DLm.

Figure 7:
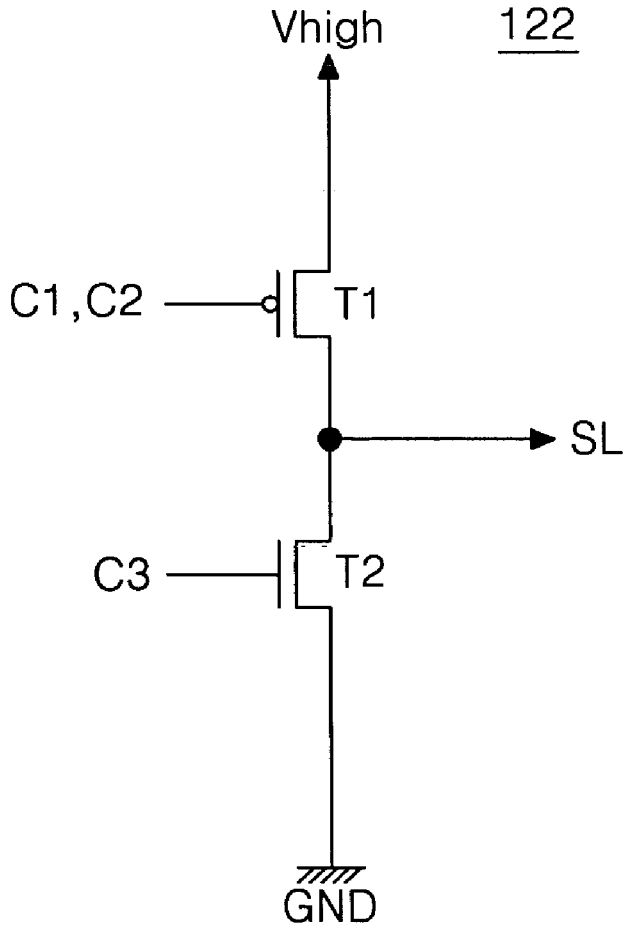
FIG. 7 is a detailed circuit diagram of the scan driver shown in FIG. 6.
Figure 8:
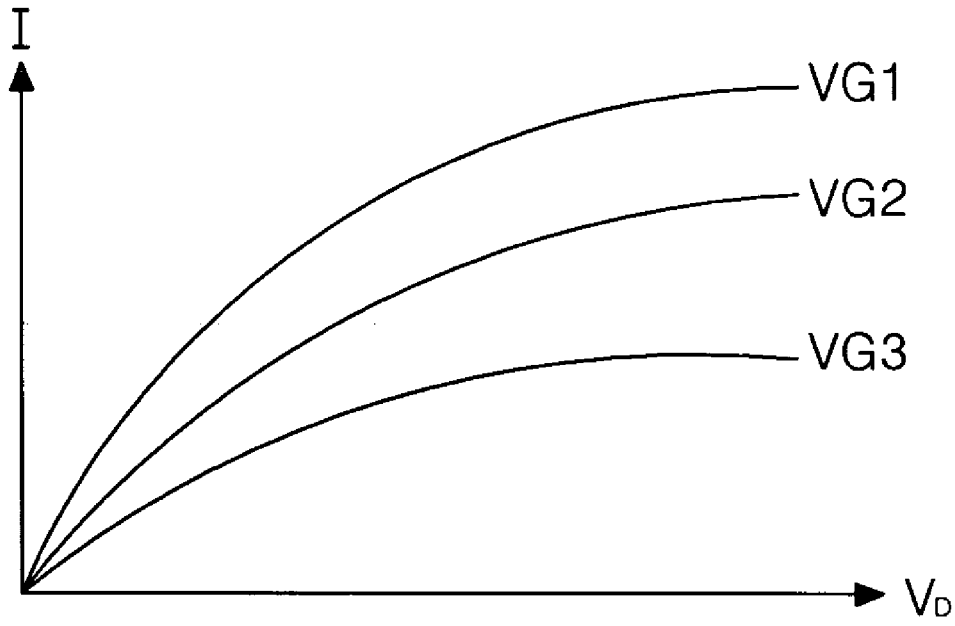
FIG. 8 is a graph showing a current amount according to a voltage applied to the gate terminal of the first switch shown in FIG. 7.

The scan driver 122 applies a negative scanning pulse SCAN to the 1st to nth scan lines SL1 to SLn on a line sequence basis. The scan driver 122 includes first and second switches T1 and T2 as shown in FIG. 7. The first and second switches T1 and T2 are implemented by a NMOS transistor and a PMOS transistor, respectively.

The first switch T1 has a source terminal connected to a scan high voltage source Vhigh and a drain terminal connected to the scan electrode line SL. The second switch T2 has a source terminal connected to the scan electrode line SL and a drain terminal connected to a ground voltage source GND.

The first switch T1 connected to the scan high voltage source Vhigh is turned on in response to first and second control signals C1 and C2 while the second switch T2 is turned off. At this time, the first switch T1 varies a channel width thereof in response to a voltage amount of the first and second control signals C1 and C2 to thereby control a current amount applied, via the scan line SL, to the EL cell 118.

More specifically, the first switch T1 is turned on in response to the first control signal C1 synchronized at a rising time of the scanning pulse. Thus, the organic EL cell 118 is supplied with a scan high voltage Vhigh having a relatively large current component. Further, the first switch T1 is turned on in response to the second control signal C2 having a lower voltage than the first control signal C1 during the sustain period for keeping a high logic state of the scanning pulse other than the rising time of the scanning pulse. Thus, the organic EL cell is supplied with a scan high voltage Vhigh having a relatively small current component during the sustain period, thereby preventing a line defect of the panel. This is caused by a fact that, as a voltage applied to the gate terminal of the first switch T1 goes larger, a current amount applied to the EL cell 118 becomes larger. The first switch T1 responding to the first and second control signals C1 and C2 in this manner applies the scan high voltage Vhigh, via the source terminal and the drain terminal of the first switch T1, to the scan line SL during a high logic interval of the scanning pulse.

The second switch T2 connected to the ground voltage source GND is turned on in response to a third control signal C3. Thus, a ground voltage is applied, via the source terminal and the drain terminal of the second switch T2, to the scan line SL during a scan low logic interval.

As mentioned above, the organic EL display device according to the first embodiment of the present invention establishes a current of the scanning pulse applied to the scan line during the sustain period for keeping a high logic state of the scanning pulse other than the rising time of the scanning pulse to have a relatively small value, thereby preventing a line defect; whereas it establishes a current of the scanning pulse to have a relatively large value at the rising time of the scanning pulse, thereby preventing a cross talk.

Figure 9:
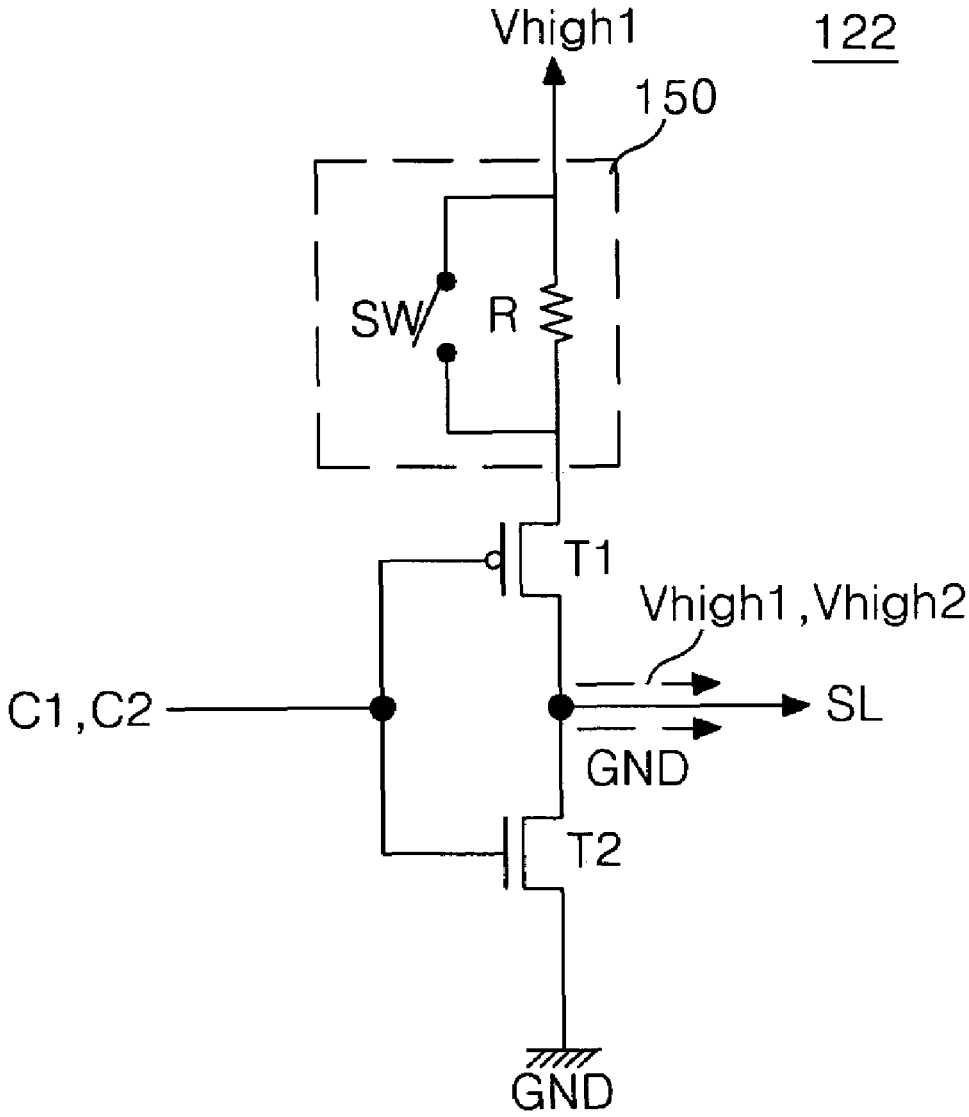
FIG. 9 is a circuit diagram showing a configuration of a driving apparatus for an organic electro-luminescence display device according to a second embodiment of the present invention.

FIG. 9 shows a configuration of a driving apparatus for an organic electro-luminescence (EL) display device according to a second embodiment of the present invention.

Referring to FIG. 9, a scan driver in the EL display device according to the second embodiment of the present invention includes first and second switches T1 and T2, and a voltage controller 150 for controlling an output voltage of the first switch T1. Herein, the driving apparatus for the EL display device shown in FIG. 9 has the same elements as the driving apparatus shown in FIG. 6 and FIG. 7 except for a scan driver. Thus, a detailed explanation as to the same elements will be omitted.

The first switch T1 has a source terminal connected to the voltage controller 150 and a drain terminal connected to the scan line SL.

The second switch T2 has a drain terminal connected to a ground voltage source GND and a source terminal connected to the scan line SL.

The voltage controller 150 includes a resistor R and a selection switch SW that are connected between a first scan high voltage source Vhigh1 and the source terminal of the first switch T1. The voltage controller 150 controls a voltage level supplied to the source terminal of the first switch T1 in response to an operation of the selection switch SW. More specifically, if the selection switch SW is turned on, then the first scan high voltage Vhigh1 with a relatively high level is supplied to the source terminal of the first switch T1. On the other hand, if the selection switch SW is turned off, then the resistor R makes a voltage drop to thereby supply a second scan high voltage Vhigh2 lower than the first scan high voltage Vhigh1 to the source terminal of the first switch T1.

The second switch T2 connected to the ground voltage source GND is turned on in response to a second control signal C2. Thus, a ground voltage is supplied, via the source terminal and the drain terminal of the second switch T2, to the scan line SL.

An operation procedure of such a scan driver 122 will be described below.

The first scan high voltage Vhigh1 is supplied to the source terminal of the first switch T1 by the selection switch SW turned on in response to a rising time of the scanning pulse, and the first switch T1 turned on by a first control signal C1 supplies the first scan high voltage Vhigh1 with a relatively high level, via the source terminal and the drain terminal of the first switch T1, to the organic EL cell 118.

Further, the second scan high voltage Vhigh2 with a relatively low level voltage-dropped by the resistor R is supplied to the source terminal of the first switch T1 by the selection switch SW turned off during the sustain period for keeping a high state of the scanning pulse other than the rising time of the scanning pulse, and the first switch T1 turned on by the first control signal C1 supplies the second scan high voltage Vhigh2 with a relatively low level, via the source terminal and the drain terminal of the first switch T1, to the organic EL cell 118.

As mentioned above, the voltage controller 150 allows the first switch T1 to supply the first scan high voltage Vhigh1 with a relatively high level to the scan line SL at the rising time of the scanning pulse SL while supplying the second scan high voltage Vhigh2 with a relatively low level to the scan line SL during the sustain period.

As mentioned above, the organic EL display device according to the second embodiment of the present invention establishes a current of the scanning pulse applied to the scan line during the sustain period for keeping a high logic state of the scanning pulse other than the rising time of the scanning pulse to have a relatively small value, thereby preventing a line defect; whereas it establishes a current of the scanning pulse to have a relatively large value at the rising time of the scanning pulse, thereby preventing a cross talk.

Figure 10:
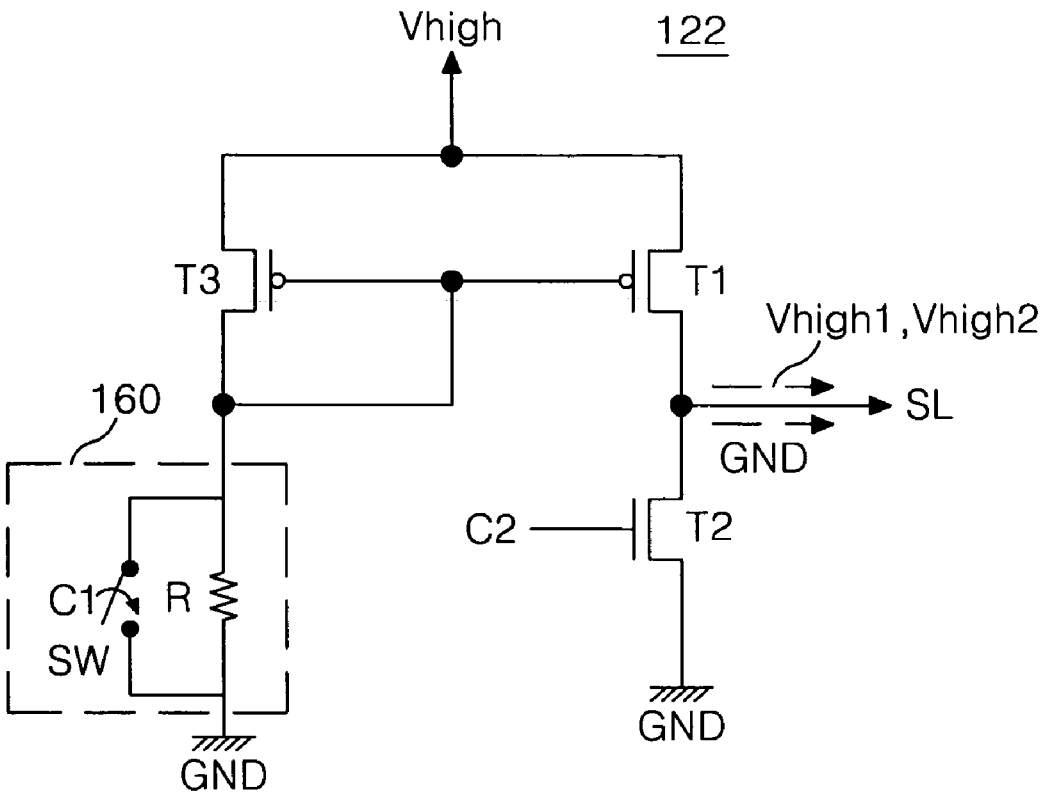
FIG. 10 is a circuit diagram showing a configuration of a driving apparatus for an organic electro-luminescence display device according to a third embodiment of the present invention.

FIG. 10 shows a configuration of a driving apparatus for an organic electro-luminescence (EL) display device according to a third embodiment of the present invention.

Referring to FIG. 10, a driving apparatus for the EL display device according to the third embodiment of the present invention includes first and second switches T1 and T2 connected to the scan line SL, a third switch T3 connected to the first switch T1 to form a current mirror, and a voltage controller 160 for controlling a channel width of the first switch T1. Herein, the driving apparatus for the EL display device shown in FIG. 10 has the same elements as the driving apparatus shown in FIG. 6 and FIG. 7 except for a scan driver. Thus, a detailed explanation as to the same elements will be omitted.

The first switch T1 has a gate terminal connected to the signal controller 160 and, at the same time, connected to a gate terminal of the third switch T3, a drain terminal connected to the scan line SL, and a source terminal connected to a scan high voltage source Vhigh. The first switch T1 varies a channel width thereof in response to a current amount from the signal controller 160 to thereby control a current amount applied from the scan high voltage source Vhigh into the EL cell 118. More specifically, a selection switch SW turned on in response to a rising time of the scanning pulse allows the first switch T1 having a first channel width to supply a first scan high voltage Vhigh1 with a relatively high level, via the source terminal and the drain terminal thereof, to the scan line SL. Further, the resistor R allows the first switch T1 having a second channel width smaller than the first channel width to supply a second scan high voltage Vhigh2 lower than the first scan high voltage Vhigh1, via the source terminal and the drain terminal thereof, to the scan line SL.

The third switch T3 has a gate terminal connected to the gate terminal of the first switch T1, a source terminal connected to the signal controller 160, and a drain terminal connected to the scan high voltage Vhigh. The third switch T3 controls an amount of a current flowing from the scan high voltage source Vhigh, via the third switch T3, into a ground voltage source GND, thereby determining an amount of a current to be flown, via the first switch T1, to the EL cell 118.

The signal controller 160 includes a selection switch SW turned on in response to a first control signal C1, and a resistor R connected, in parallel, to the selection switch SW. The signal controller 160 controls a current amount to be applied to the gate terminals of the first and second switches T1 and T2. More specifically, if the selection switch SW is turned on, then the first control signal C1 with a relatively high level is applied to the gate terminals of the first and second switches T1 and T2. On the other hand, if the selection switch SW is turned off, then a second control signal C2 having a lower level than the first control signal C1 is applied to the gate terminal of the first switch T1 by the resistor R.

The second switch T2 has a gate terminal responding to the second control signal C2, a drain terminal connected to the ground voltage source GND, and a source terminal connected to the scan line SL.

As mentioned above, the organic EL display device according to the third embodiment of the present invention establishes a current of the scanning pulse applied to the scan line during the sustain period for keeping a high logic state of the scanning pulse other than the rising time of the scanning pulse to have a relatively small value, thereby preventing a line defect; whereas it establishes a current of the scanning pulse to have a relatively large value at the rising time of the scanning pulse, thereby preventing a cross talk.

Figure 11:
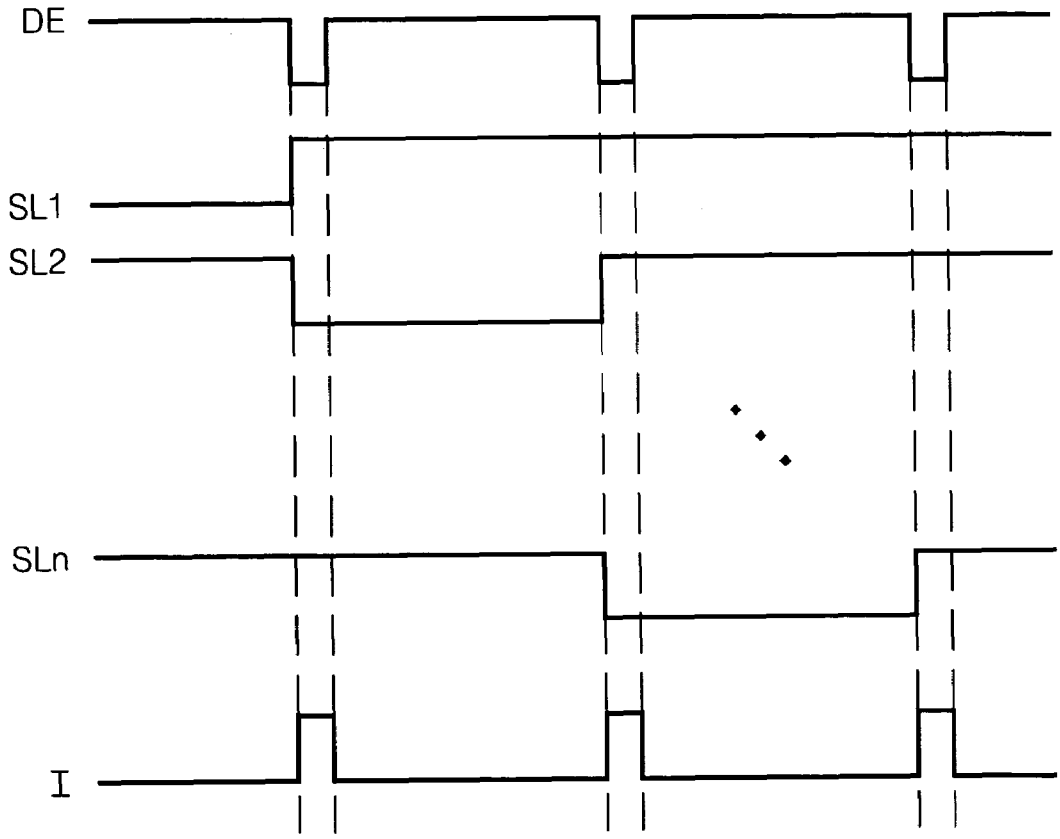
FIG. 11 is a waveform diagram of driving signals generated from the driving apparatus for the organic electro-luminescence display device according to any one of the first to third embodiment of the present invention.

FIG. 11 is a waveform diagram for explaining a method of driving the EL display device according to any one of the first to third embodiments of the present invention.

Referring to FIG. 11, a scanning pulse is sequentially applied to the 1st to nth scan lines SL1 to SLn by means of the driving apparatus for the EL display device according to any one of the first to third embodiments of the present invention. In other words, a scanning pulse having a relatively large current amount is applied to the 1st to nth scan lines SL1 to SLn in a data enable (DE) interval having a high state, whereas a scanning pulse having a relatively large current amount is applied to the 1st to nth scan lines SL1 to SLn in a data enable (DE) interval having a low state.

As described above, according to the present invention, a current included in the scan voltage has a relatively large amount in a time interval when the scan voltage is changed from a low state into a high state, that is, in a rising edge while it has a relatively small amount in the remaining interval. Accordingly, the scan voltage and current are relatively low when particles exist in the interior of the panel, so that a probability of the line defect can be lowered.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A driving apparatus for an electro-luminescence display device comprising:

a display panel having a scan line connected to a cathode, a data line connected to an anode and intersecting the scan line and supplied with a data, and a light-emitting device positioned at the intersection between the scan line and the data line;

a data driver configured to supply a data to the data line; and a scan driver configured to apply a high voltage scan pulse to the scan line, the high voltage scan pulse including a first current value during a rise period of the high voltage scan pulse and a second current value during a period of the high voltage scan pulse subsequent to the rise period, the first current value being higher than the second current value, wherein the scan driver includes a first switch configured to supply a scan high voltage; and a second switch for selectively supplying a ground voltage to the scan line, and wherein the second switch has a first channel width during said rise period while having a second channel width smaller than said first channel width during said period of the high voltage scan pulse subsequent to the rise period.

2. The driving apparatus according to claim 1, wherein the scan driver is synchronized with a data enable signal indicating a time interval when said data exists to apply said high voltage scan pulse.

3. The driving apparatus according to claim 1, wherein said scan driver is configured to apply a control signal to a gate terminal of the first switch during said rise period and another control signal to the gate terminal of the first switch during said period of the high voltage scan pulse subsequent to the rise period, the control signal applied during the rise period having a higher voltage than the another control signal applied during the period of the high voltage scan pulse subsequent to the rise period.

4. The driving apparatus according to claim 1, wherein the scan driver includes:

a first switch configured to selectively supply a scan high voltage to the scan line;

a second switch to selectively supply a ground voltage to the scan line; and a signal controller configured to control a level of said high voltage scan pulse.

5. The driving apparatus according to claim 4, wherein the signal controller includes:

a third switch configured to be turned on during the rise period; and a resistor connected in parallel to the third switch.

6. A method of driving an electro-luminescence display device, comprising the steps of:

applying a high voltage scan pulse to a scan line connected to a cathode, the high voltage scan pulse including a first current value during a rise period of the high voltage scan pulse and a second current value during a period of the high voltage scan pulse subsequent to the rise period, the first current value being higher than the second current value; and supplying a data to a data line connected to an anode and crossing the scan line in synchronization with said high voltage scan pulse, wherein said step of applying comprises supplying a scan high voltage with a first switch, and selectively supplying a ground voltage to the scan line with a second switch, and wherein the second switch has a first channel width during the rise period and has a second channel width smaller than the first channel width during the period of the high voltage scan pulse subsequent to the rise period.

7. The method of claim 6, further comprising:

applying a control signal to a gate terminal of the first switch during said rise period and applying another control signal to the gate terminal of the first switch during said period of the high voltage scan pulse subsequent to the rise period, the control signal applied during the rise period having a higher voltage than the another control signal applied during the period of the high voltage scan pulse subsequent to the rise period.

* * * * *